United States Patent [19]

Terauchi et al.

[11] Patent Number: 4,505,651

[45] Date of Patent: Mar. 19, 1985

[54] SCROLL TYPE COMPRESSOR WITH DISPLACEMENT ADJUSTING MECHANISM

[75] Inventors: Kiyoshi Terauchi, Gunma; Akihiro Kawano, Maebashi; Atsushi Mabe, Gunma, all of Japan

[73] Assignee: Sanden Corporation, Gunma, Japan

[21] Appl. No.: 521,258

[22] Filed: Aug. 8, 1983

[30] Foreign Application Priority Data

Aug. 7, 1982 [JP] Japan ..... 57-137650

[51] Int. Cl.[3] ..... F01C 17/06; F01C 1/02; F04C 18/02; F04C 29/08

[52] U.S. Cl. ..... 417/440; 418/55

[58] Field of Search ..... 418/55; 417/310, 440, 417/441

[56] References Cited

U.S. PATENT DOCUMENTS 4,431,388 2/1984 Eber et al. ..... 417/440 X

FOREIGN PATENT DOCUMENTS 60140 9/1982 European Pat. Off. ..... 418/55

61064 9/1982 European Pat. Off. ..... 418/55

*Primary Examiner*—Richard E. Gluck

*Attorney, Agent, or Firm*—Banner, Birch, McKie & Beckett

[57] ABSTRACT

A scroll type compressor is disclosed. The compressor includes a housing having a fluid inlet port and an outlet port. A fixed scroll is fixed within the housing and has a circular end plate from which a first wrap extends. The end plate of the fixed scroll partitions the inner chamber of the housing into a front chamber connected to the fluid inlet port and a rear chamber. The rear chamber is divided into a central chamber connected to the fluid outlet port and an outer chamber. An orbiting scroll, which is disposed in the front chamber, also has a circular end plate from which a second wrap extends. Both wraps interfit at angular and radial offsets to form a plurality of line contacts to define at least one pair of sealed off fluid pockets. The end plate of the fixed scroll has at least two holes which are placed at symmetrical position and connect the fluid pockets to the outer chamber. The end plate also has a communicating hole which connects the first chamber and the outer chamber. Valve members are disposed in the outer chamber for opening and closing each hole. A control mechanism which is disposed in the outer chamber controls the operation of the valve members.

4 Claims, 6 Drawing Figures

SCROLL TYPE COMPRESSOR WITH DISPLACEMENT ADJUSTING MECHANISM

BACKGROUND OF THE INVENTION

This invention relates to a compressor, and more particularly, to a scroll type compressor for an automobile air conditioning system which includes a mechanism for adjusting the displacement of the compressor.

Scroll type fluid displacement devices are well known in the prior art. For example, U.S. Pat. No. 801,182 issued to Creux discloses such a device which includes two scrolls, each having a circular end plate and a spiroidal or involute spiral element. The scrolls are maintained angularly and radially offset so that both spiral elements interfit to form a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets increases or decreases, dependent on the direction of the orbital motion. Thus, a scroll type fluid displacement device may be used to compress, expand or pump fluids.

Scroll type fluid displacement devices are suitable for use as refrigerant compressors in air conditioners. In such air conditioners, thermal control in the room or control of the air conditioner is generally accomplished by intermittent operation of the compressor. Once the temperature in the room has been cooled to a desired level, the refrigerant capacity of the air conditioner required for maintaining the room at the desired temperature is usually not very large. Because air conditioners known in the prior art do not have a capacity control mechanism, the room is maintained at the desired temperature by intermittent operation of the compressor. Thus, the relatively large load which is required to drive the compressor is intermittently applied by the driving source. Operation of the compressor in this manner wastefully consumes large amounts of energy.

When prior art scroll type compressors are used in automobile air conditioners, they are usually driven by the automobile engine through an electromagnetic clutch. Once the passenger compartment is cooled to the desired temperature, control of the output of the compressor is accomplished by intermittent operation of the compressor through the electromagnetic clutch. Thus, the relatively large load which is required to drive the compressor is intermittently applied by the automobile engine. Accordingly, scroll type compressors known in the prior art which are used in automobile air conditioners also wastefully consume large amounts of energy in maintaining the desired temperature in the passenger compartment.

It is desirable to provide a scroll type compressor which includes a displacement or volume adjusting mechanism which controls the compression ratio as occasion demands. In a scroll type compressor, control of the compression ratio can be easily accomplished by controlling the volume of the sealed off fluid pockets. A displacement adjusting mechanism is disclosed in copending application Ser. No. 356,648 filed on Mar. 9, 1982. This application discloses a mechanism which includes a pair of holes formed through one of the end plates of the scrolls. The pair of holes directly connect the intermediate fluid pockets to the suction chamber. The opening and closing of the holes is usually controlled by an electrically operated valve plate which is displaced in the suction chamber.

While the displacement adjusting mechanism disclosed in application Ser. No. 356,648 significantly improves the operation of scroll type compressors known in the prior art, the mechanism is deficient in several areas. For example, in scroll type compressors, the pressure in the suction chamber is usually lower than the pressure in the sealed off fluid pockets. Thus, when the valve plates are operated to open the holes in the scroll end plate, fluid from the fluid pockets may be inadvertently drawn into the suction chamber. Furthermore, the valve plates must be operated by one or more magnetic coils which adds additional complexity to the system.

SUMMARY OF THE INVENTION

It is a primary object of this invention to improve the operation of a scroll type compressor by incorporating a mechanism for changing the compression ratio of the compressor as occasion demands without a wasteful consumption of energy.

It is another object of this invention to provide a scroll type compressor in which the volume reduction ratio of the fluid pockets can be freely selected as occasion demands without unnecessary operation of the compressor.

It is still another object of this invention to provide a scroll type compressor wherein moving parts, in particular a shaft seal portion, are efficiently lubricated and cooled.

It is a further object of this invention to provide a scroll type compressor in which the fluid pockets remain sealed while achieving the above objects.

A scroll type compressor according to this invention includes a housing having a fluid inlet port and a fluid outlet port. A fixed scroll and an orbiting scroll are disposed in the housing. The fixed scroll is fixedly disposed and has a circular end plate from which a first wrap extends into the interior of the housing. The orbiting scroll also has a circular end plate from which a second wrap extends. The first and second wraps interfit at an angular and radial offset to form a plurality of line contacts to define at least one pair of sealed fluid pockets. A driving mechanism is operatively connected to the orbiting scroll to effect the orbital motion of the orbiting scroll by rotation of a drive shaft while rotation of the orbiting scroll is prevented by a rotation preventing device. Therefore, the fluid pockets shift along the spiral curved surface of the wrap which changes the volume of the fluid pockets. The circular end plate of the fixed scroll partitions the inner chamber of the housing into a suction chamber and a discharge chamber. The discharge chamber is divided by a further partition wall to provide an intermediate pressure chamber and a smaller discharge chamber. One of the circular end plates has at least one pair of holes formed therein. The holes are placed in symmetrical positions so that the wrap of the other scroll simultaneously crosses over the holes and connects the sealed off fluid pockets to the intermediate pressure chamber. One of the holes is placed within an area defined by $\phi end > \phi 1 > \phi end - 2\pi$ where $\phi$ end is the final involute angle of the wrap which extends from the end plate having the hole pair and $\phi 1$ is the involute angle at which the hole is located. A communicating hole is formed through the end plate having the hole pair and is located at the outer side of the terminal end of the wrap for communication between the suction chamber and the intermediate pressure chamber. A control device which controls the opening and closing of the communicating hole is disposed within the intermediate pressure chamber. Valve members which control the opening and closing of each hole of the hole pair is fixed on the end plate face of the intermediate pressure chamber. The displacement volume of the fluid pockets is controlled by opening and closing the communicating hole with the control device.

Further objects, features and other aspects of this invention will be understood from the detailed description of the preferred embodiment of this invention with reference to the annexed drawings.

DETAILED DESCRIPTION OF THE PREFERRED EMBODIMENT

Figure 1:
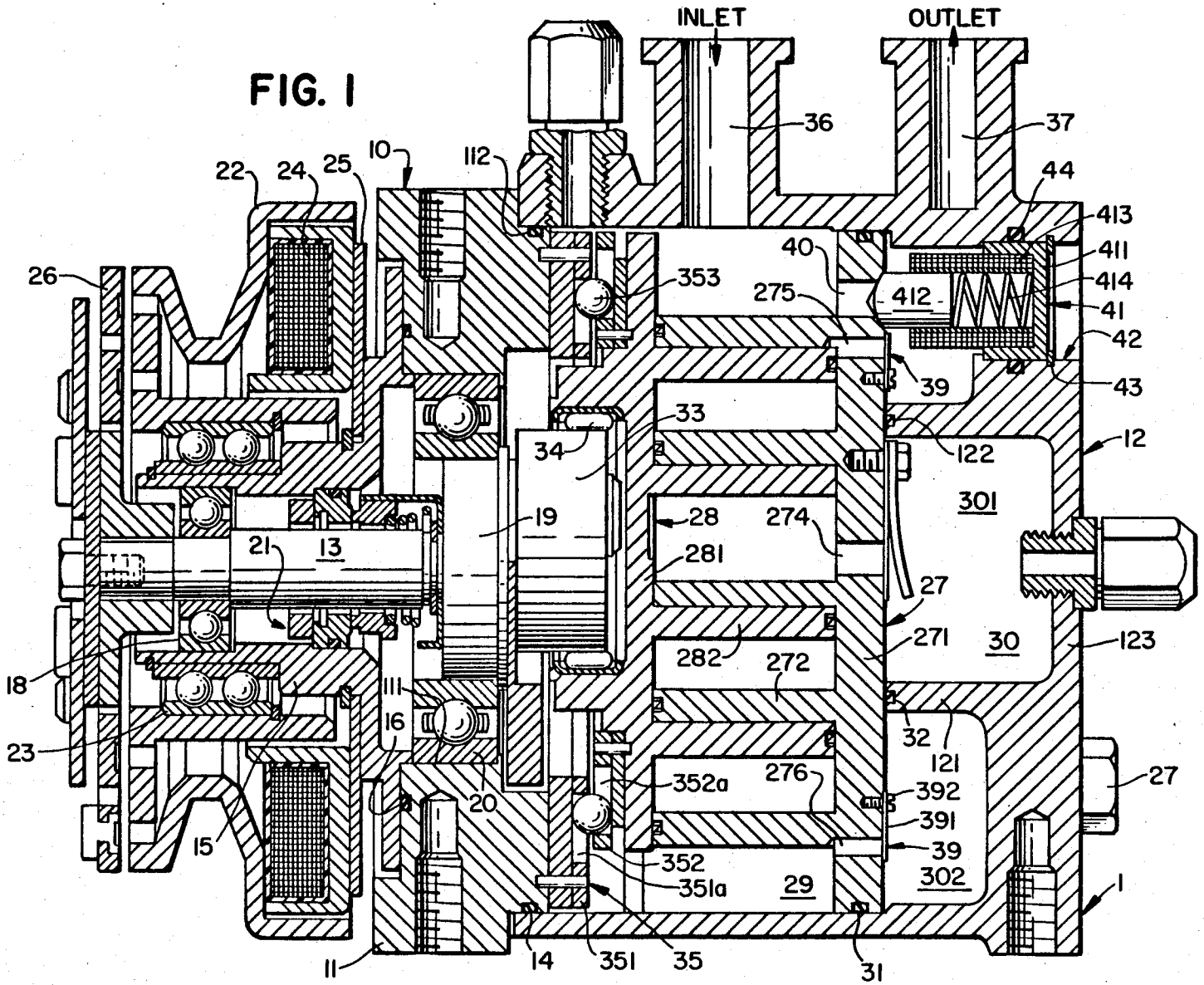
FIG. 1 is a vertical sectional view of a scroll type compressor unit in accordance with one embodiment of this invention.

Referring to FIG. 1, a refrigerant compressor in accordance with an embodiment of the present invention, in particular, a scroll type refrigerant compressor 1, is shown. Compressor 1 includes compressor housing 10 having a front end plate 11 and a cup-shaped casing 12 which is attached to an end surface of front end plate 11. An opening 111 is formed in the center of front end plate 11 for penetration or passage of a drive shaft 13. An annular projection 112 is formed in a rear end surface of front end plate 11. Annular projection 112 faces cup-shaped casing 12 and is concentric with opening 111. An outer peripheral surface of annular projection 112 extends into an inner wall of the opening of cup-shaped casing 12. Thus, the opening of cup-shaped casing 12 is covered by front end plate 11. An O-ring 14 is placed between the outer peripheral surface of annular projection 112 and the inner wall of the opening of cup-shaped casing 12 to seal the mating surfaces of front end plate 11 and cup-shaped casing 12.

Annular sleeve 15 projects from the front end surface of front end plate 11 to surround drive shaft 13 and defines a shaft seal cavity. In the embodiment shown in FIG. 1, sleeve 15 is formed separately from front end plate 11. Therefore, sleeve 15 is fixed to the front end surface of front end plate 11 by screws (not shown). O-ring 16 is placed between the end surface of sleeve 15 and the front end surface of front end plate 11 to seal the mating surface of front end plate 11 and sleeve 15. Alternatively, sleeve 15 may be formed integral with front end plate 11.

Drive shaft 13 is rotatably supported by sleeve 15 through bearing 18 located within the front end of sleeve 15. Drive shaft 13 has a disk 19 at its inner end which is rotatably supported by front end plate 11 through bearing 20 located within opening 111 of front end plate 11. Shaft seal assembly 21 is coupled to drive shaft 13 within the shaft seal cavity of sleeve 15.

Pulley 22 is rotatably supported by bearing 23 which is carried on the outer surface of sleeve 15. Electromagnetic coil 23 is fixed about the outer surface of sleeve 15 by support plate 25 and is received in an annular cavity of pulley 22. Armature plate 26 is elastically supported on the outer end of drive shaft 13 which extends from sleeve 15. Pulley 22, magnetic coil 24 and armature plate 26 form a magnetic clutch. In operation, drive shaft 13 is driven by an external power source, for example the engine of an automobile, through a rotation transmitting device such as the above-explained magnetic clutch.

A number of elements are located within the inner chamber of cup-shaped casing 12 including fixed scroll 27, orbiting scroll 28, a driving mechanism for orbiting scroll 28 and rotation preventing/thrust bearing device 35 for orbiting scroll 28. The inner chamber of cup-shaped casing 12 is formed between the inner wall of cup-shaped casing 12 and the rear end surface of front end plate 11.

Fixed scroll 27 includes circular end plate 271 and wrap or spiral element 272 affixed to or extending from one end surface of end plate 271. Fixed scroll 27 is fixed within the inner chamber of cup-shaped casing 12 by screws 27 screwed into end surface 271 from outside of cup-shaped casing 12. Circular end plate 271 of fixed scroll 27 partitions the inner chamber of cup-shaped casing 12 into front chamber 29 and a rear chamber 30. Seal ring 31 is disposed within a circumferential groove of circular end plate 271 to form a seal between the inner wall of cup-shaped casing 12 and the outer surface of circular end plate 271. Spiral element 272 of fixed scroll 27 is located within front chamber 29.

Annular partition wall 121 axially projects from the inner end surface of cup-shaped casing 12. The end surface of partition wall 121 contacts against the end surface of circular end plate 271. Seal ring 32 is located between the axial end surface of partition wall 121 and the end surface of circular end plate 271 to seal the contacting surfaces of circular end plate 271 and partition wall 121. Thus, partition wall 121 divides rear chamber 30 into discharge chamber 301, formed at the center portion of rear chamber 30, and intermediate pressure chamber 302, formed at the outer peripheral portion of rear chamber 30.

Orbiting scroll 28, which is located in front chamber 29, includes circular end plate 281 and wrap or spiral element 282 affixed to or extending from one end surface of circular end plate 281. Spiral elements 272 and 282 interfit at an angular offset of 180° C. and at a predetermined radial offset. Spiral elements 272 and 282 define at least one pair of sealed off fluid pockets between their interfitting surfaces. Orbiting scroll 28 is rotatably supported by bushing 33 through bearing 34 placed on the outer peripheral surface of bushing 33. Bushing 33 is connected to an inner end of disk 19 at a point radially offset or eccentric of the axis of drive shaft 13.

Rotation preventing/thrust bearing device 35 is placed between the inner end surface of front end plate 11 and the end surface of circular end plate 281 which faces the inner end surface of front end plate 11. Rotation preventing/thrust bearing device 35 includes a fixed ring 351 attached to the inner end surface of front end plate member 11, an orbiting ring 352 attached to the end surface of circular end plate 281, and a plurality of bearing elements, such as balls 353, placed between pockets 351*a*, 352*a* formed by rings 351 and 352. Rotation of orbiting scroll 28 during orbital motion is prevented by the interaction of balls 353 with rings 351, 352. The axial thrust load from orbiting scroll 28 is supported on front end plate 11 through balls 353.

Cup-shaped casing 12 has an inlet port 36 and an outlet port 37 for connecting the compressor unit to an external fluid circuit. Fluid from the external fluid circuit is introduced into fluid pockets in the compressor unit through inlet port 36. The fluid pockets comprise open spaces formed between spiral elements 272 and 282 as explained below. As orbiting scroll 28 orbits, the fluid in the fluid pockets moves to the center of the spiral elements and is compressed. The compressed fluid from the fluid pockets is discharged into discharge chamber 301 of rear chamber 30 from the fluid pockets through hole 274 formed through circular end plate 271. The compressed fluid is then discharged to the external fluid circuit through outlet port 37.

During operation of the compressor, fluid is taken into the fluid pockets which are formed in open spaces between the outer terminal end of one of the spiral elements 272, 282 and the outer wall surface of the other spiral element. The entrance to these fluid pockets or open spaces sequentially opens and closes during the orbital motion of orbiting scroll 28. When the entrances to the fluid pockets are open, fluid to be compressed flows into them but no compression occurs. When the entrances are closed, sealing off the fluid pockets, no additional fluid flows into the pockets and compression begins. The location of the outer terminal end of each spiral element 272, 282 is at the final involute angle. Therefore, the location of the fluid pockets is directly related to the final involute angle.

Figure 2:
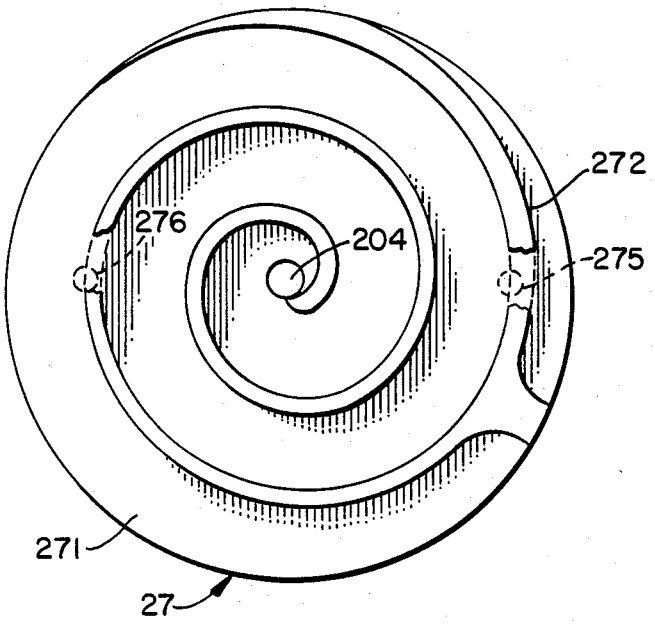
FIG. 2 is a front end view of the fixed scroll member used in the compressor of FIG. 1.

Referring to FIG. 2, the final involute angle ($\phi$ end) at the end of spiral element 272 of fixed scroll member 27 is greater than $4\pi$. At least one pair of holes, 275 and 276, are formed in end plate 272 of fixed scroll member 27 and are placed at symmetrical positions so that an axial end surface of spiral element 282 of orbiting scroll member 28 simultaneously crosses over holes 275 and 276. Hole 275 communicates between intermediate pressure chamber 302 of rear chamber 30 and one of the fluid pockets A and hole 276 communicates between intermediate chamber 302 and the other fluid pocket A'. (See FIG. 4*a*)

Hole 275 is placed at a position defined by involute angle $\phi 1$ and opens along the inner wall side of spiral element 272. Thus 100 1 is the involute angle location of the first hole, which is nearest the final involute angle ($\phi$ end) at the end of spiral element 272. The other hole 276 is placed at a position defined by the involute angle ($\phi 1-\pi$) and opens along the outer wall side of spiral element 272. The preferred area within which to place first hole 275, as defined in involute angles, is given by $\phi\text{end}>\phi 1>\phi\text{end}-2\pi$. The other hole 276 is located further from $\phi$ end, i.e., at $\phi 1-\pi$.

Figure 3:
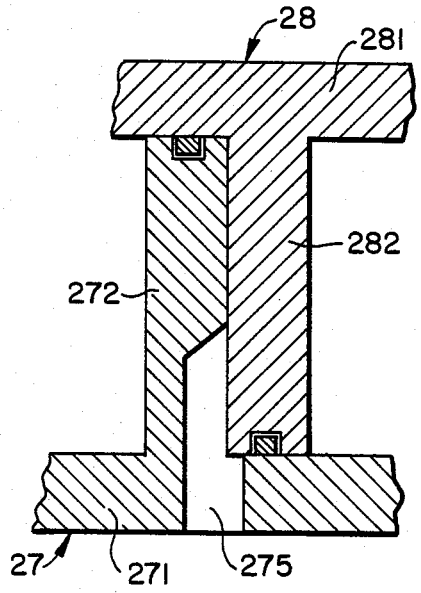
FIG. 3 is a sectional view of the spiral elements illustrating one of the holes of the hole pair extending into one of the spiral elements.

Holes 275 and 276 are formed by drilling into end plate 271 from the side opposite from which spiral element 272 extends. Hole 275 is drilled at a position which overlaps with the inner wall of spiral element 272, so that a portion of the inner wall of spiral element 272 is removed. Hole 276 is drilled at a position which overlaps the outer wall of spiral element 272 so that a portion of the outer wall of spiral element 272 is removed. The overlapping of hole 275 is shown in detail in FIG. 3. In this arrangement, the axial end surface of each spiral element is provided with a seal which forms an axial seal between the spiral element and the facing end plate 271, 281. Holes 275 and 276 are positioned so that they do not connect with the fluid pockets between spiral elements 272, 282 when spiral element 282 completely overlaps the holes. This is accomplished by extending a portion of each hole of sufficient size into spiral element 272 which results in seal element 38 in spiral element 282 remaining completely in contact with end plate 271 when spiral element 282 completely overlaps the holes.

A control device, such as valve member 39, having a plurality of valve plates 391 is attached to the end surface of end plate 271 at holes 275 and 276 and by fastner 392. Valve plate 391 is made of a spring type material so that the inherent spring tendency of each valve plate 391 pushes it against the opening of a respective hole 275, 276, thus closing the opening of each hole.

End plate 271 of fixed scroll 27 also includes communicating hole 40 at the outer side portion of the terminal end of spiral element 272. Communicating hole 40 connects suction chamber 29 to intermediate pressure chamber 302. A control mechanism 41 is located in intermediate pressure chamber 302 and fixedly disposed within hole 42 formed through bottom end plate 122 of cup-shaped casing 12. Control mechanism 41 includes a cup-shaped holding member 411 which is held against axial movement in hole 42 by snap ring 43, valve body 412 which is slidably disposed within holding member 411 and an elastic member such as coil spring 414 which is disposed between the axial end surface of valve body 412 and the bottom end portion of holding member 411. Sealing member 44 is located between an outer peripheral surface of holding member 411 and the inner surface of hole 42 to seal cup-shaped casing 12 and control mechanism 41.

In this embodiment, valve body 412 is controlled by the operation of magnetic coil 413. Coil spring 414 pushes valve body 412 against the opening of communicating hole 40 thus closing the opening of hole 40 when coil 413 is not energized. When coil 413 is energized, valve body 412 is attracted toward the bottom end portion of holding member 411 against the spring tension of coil spring 414. The energization of magnetic coil 413 is controlled to operate in the manner described below by an electrical circuit (not shown) like the electrical circuits disclosed in copending Ser. No. 472,497 filed Mar. 7, 1983.

Figure 4A:
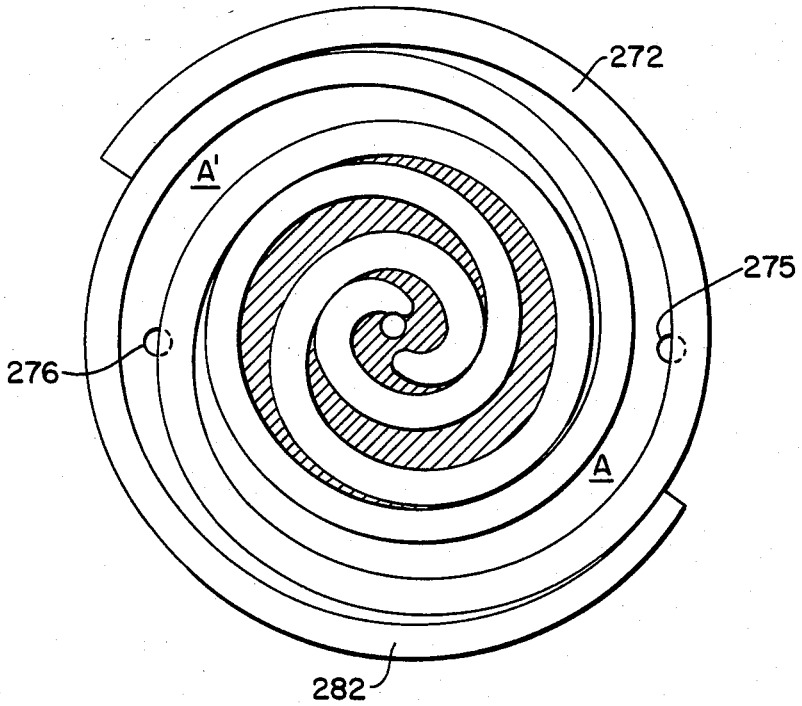
FIGS. 4*a*–4*c* are schematic views illustrating the operation of the volume or displacement adjusting mechanism utilizing a pair of holes.
Figure 4B:
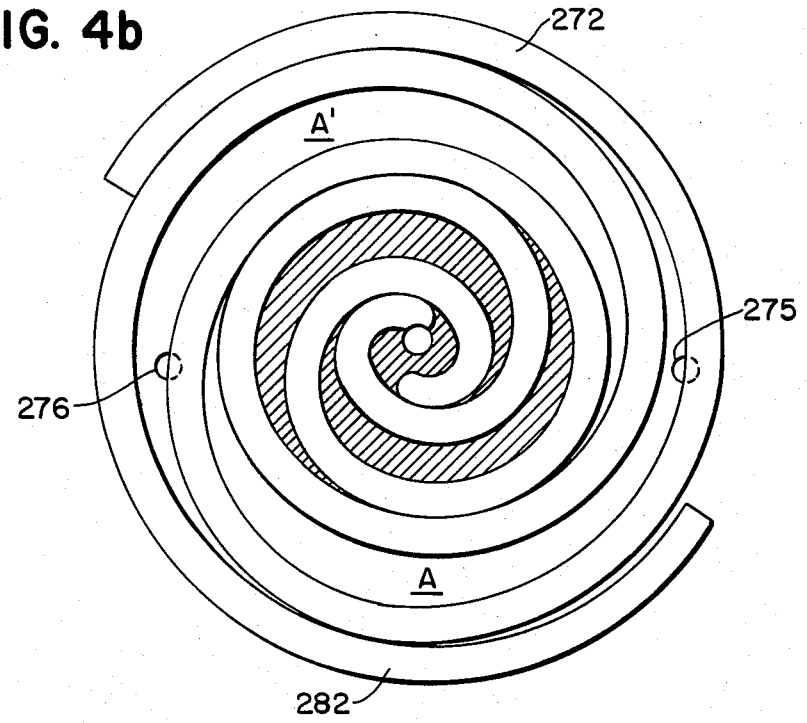
Figure 4C:
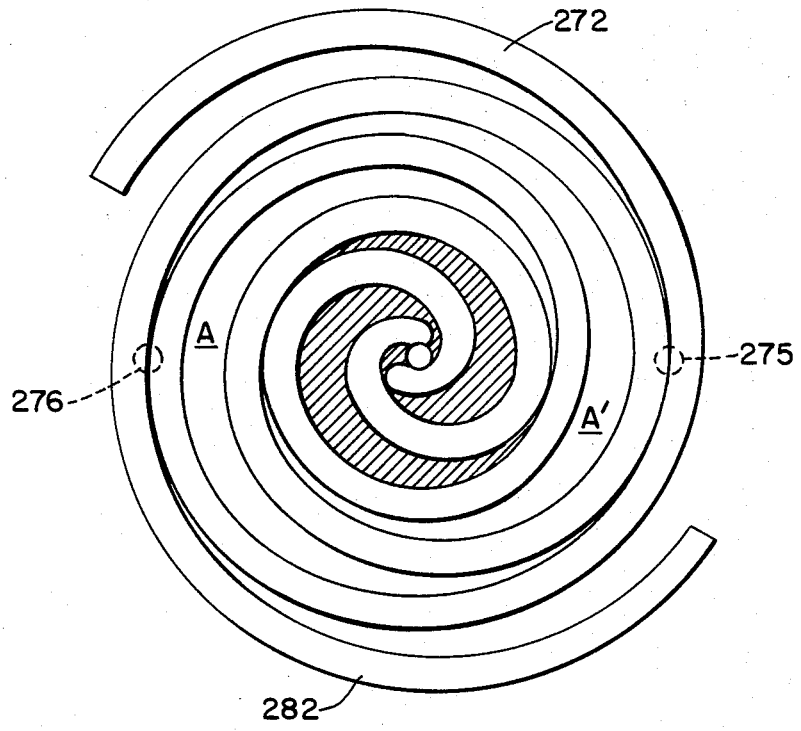

Referring to FIGS. 4*a*–4*c*, the operation of the mechanism for changing the displacement volume of the fluid pockets, i.e., the volume of the sealed off fluid pockets at the time compression begins, will now be described.

During orbital motion when the terminal end portion of each spiral element 272, 282 is in contact with the opposite end wall of the other spiral element, a pair of sealed fluid pockets A, A' are simultaneously formed at symmetrical locations as shown in FIG. 4*a*. If magnetic coil 413 is not energized, communicating hole 40 is closed by valve body 412 in response to coil spring 414 so that compression of the fluid taken into the fluid pockets begins. The fluid in the fluid pockets moves to the center of the spiral elements with a resultant volume reduction and compression and is discharged into discharge chamber 301 through discharge hole 274. At the initial stage of operation, the pressure in fluid pockets A, A' increases above the pressure in intermediate pressure chamber 302. Therefore, valve plate 391 is operated by the pressure difference between fluid pockets A, A' and intermediate pressure chamber 302 to open holes 275, 276. Thus, the fluid in fluid pockets A, A' is permitted to leak back to intermediate pressure chamber 302 through holes 275, 276. This condition continues until the pressure in fluid pockets A, A' is equal to the pressure in intermediate pressure chamber 302. When pressure equalization is reached, holes 275, 276 are closed by the spring tension in valve plate 391 so that compression operates normally and the displacement volume of the sealed off fluid pockets is the same as the displacement volume is when the terminal ends of each respective spiral element 272, 282 first contacts the other spiral element.

When valve body 412 is attracted toward holding member 411 by activating magnetic coil 413, communicating hole 40 is opened. Thus, intermediate pressure chamber 302 is connected to suction chamber 29 through hole 40. The pressure in intermediate chamber 302 maintains the suction pressure. Since the pressure in the sealed off fluid pockets increases above the pressure in intermediate chamber 302, i.e., the suction pressure, valve plates 391 are operated to open holes 275, 276 by the imbalance in fluid pressures. Therefore, fluid from the sealed off fluid pockets A, A' leaks back into intermediate chamber 302 during the orbital motion of orbiting scroll 28 from the position shown in FIG. 4*a* to the position shown in FIG. 4*b*. During leaking or back flow, compression cannot begin. Leaking continues until the axial end surface of spiral element 282 of orbiting scroll 28 crosses over holes 275 and 276 as shown in FIG. 4*c*. As a result, the actual compression stroke of fluid pockets A, A' starts after spiral element 282 of orbiting scroll 28 crosses over holes 275, 276, The volume of fluid pockets A, A' at the time when the pockets are sealed from intermediate chamber 302 (and compression actually begins), is thereby reduced. Therefore, the capacity of the compressor is reduced.

In the preferred embodiment, the involute angle location of first hole 275 is given by $\phi 1 > \phi end - 2\pi$. The closer $\phi 1$ is to $\phi end - 2\pi$, the larger the reduction of the displacement volume. Conversely, the closer $\phi 1$ is made to $\phi$ end, the smaller the reduction in the displacement volume. If the reduction in displacement volume is too small, excess compression capacity would remain for conditions when only small temperature differentials are to be adjusted for by the air conditioning system.

As mentioned above, in this invention the displacement volume changing mechanism includes an intermediate pressure chamber which is connected to a suction chamber through a communicating hole and is also connected to a pair of sealed off fluid pockets through a pair of holes. Entrance to the communicating hole is controlled by a control device while a valve member is disposed over each hole of the hole pair to control their opening and closing. In this embodiment, the volume changing operation is followed by an operation which prevents fluid leakage through holes formed in the end plate during normal operation of the compressor. Thus, efficient volume changing is realized.

This invention has been described in detail in connection with a preferred embodiment. This embodiment, however, is merely for example only and the invention is not restricted thereto. It will be easily understood by those skilled in the art that other variations and modifications can easily be made within the scope of this invention, as defined by the appended claims.

We claim:

1. In a scroll type fluid compressor including a housing having a fluid inlet port and a fluid outlet port, a fixed scroll fixedly disposed within said housing and having a circular end plate from which a first wrap extends into the interior of said housing, an orbiting scroll having a circular end plate from which a second wrap extends, said first and second wraps interfitting at angular and radial offsets to form a plurality of line contacts to define at least one pair of sealed off fluid pockets, a driving mechanism operatively connected to said orbiting scroll to effect the orbital motion of said orbiting scroll by rotation of a drive shaft and rotation preventing means for preventing the rotation of said orbiting scroll during orbital motion to thereby change the volume of the fluid pockets, the improvement comprising:

said end plate of said fixed scroll partitioning the interior of said housing into a first chamber in which said first wrap extends and a second chamber;

a partition wall disposed within said second chamber to provide an outer peripheral chamber and a central chamber;

at least one pair of holes formed through said end plate of said fixed scroll to form a fluid communication channel between the pair of fluid pockets and said outer peripheral chamber, said pair of holes being located at symmetrical locations along said first wrap so that said second wrap simultaneously crosses over both of said pair of holes, a first of said pair of holes being located within an area defined by $\phi end > \phi 1 > \phi end - 2\pi$ where $\phi$ end is the final infolute angle of said first wrap and $\phi 1$ is the involute angle at which said first hole is located, the other of said holes being located at an involute angle of approximately 100 $1 - \pi$;

a valve member associated with each hole to selectively control the opening and closing of said pair of holes;

a communicating hole formed through said end plate of said fixed scroll to form a fluid communication channel between said first chamber and said outer peripheral chamber, said communicating hole being located at the outside of a terminal end of said first wrap; and control means for selectively controlling the opening and closing of said communicating hole to permit fluid communication therethrough.

2. The scroll type compressor of claim 1 wherein said control means includes a holder fixed on said housing, a valve body slidably fitted in said holder and covering said communicating hole and an electromagnetic coil to move said valve body toward and away from said end plate of said fixed scroll to open and close said communicating hole.

3. The scroll type compressor of claim 1 wherein each said valve member comprises a separate flat plate attached adjacent each of said pair of holes.

4. The scroll type compressor of claim 1 wherein said pair of holes extends into a portion of said first wrap which extends from said end plate of said fixed scroll.

* * * * *